US008944864B2

(12) United States Patent
Kuriyagawa et al.

(10) Patent No.: US 8,944,864 B2
(45) Date of Patent: Feb. 3, 2015

(54) OUTBOARD MOTOR CONTROL APPARATUS

(75) Inventors: Koji Kuriyagawa, Saitama (JP); Akifumi Fujima, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 268 days.

(21) Appl. No.: 13/488,585

(22) Filed: Jun. 5, 2012

(65) Prior Publication Data

US 2012/0315809 A1 Dec. 13, 2012

(30) Foreign Application Priority Data

Jun. 8, 2011 (JP) ..... 2011-128264

(51) Int. Cl.

| | |
|---|---|
| ***B63H 21/22*** | (2006.01) |
| ***B63H 23/00*** | (2006.01) |
| ***B63J 3/02*** | (2006.01) |
| *B63H 21/21* | (2006.01) |
| *B63H 20/00* | (2006.01) |
| *B63J 3/00* | (2006.01) |

(52) U.S. Cl.

CPC . *B63J 3/02* (2013.01); *B63H 21/21* (2013.01); *B63H 2020/003* (2013.01); *B63J 2003/002* (2013.01)

USPC ..... 440/1

(58) Field of Classification Search

CPC ..... B63H 2020/00; B63H 2021/21; B63H 19/00; B63H 2021/216; B63H 2020/003; B63H 21/21; F02D 9/08; F02D 41/04

USPC ..... 440/1, 3, 49, 84, 87; 701/110, 115

See application file for complete search history.

(56) References Cited

U.S. PATENT DOCUMENTS

2002/0177940 A1 * 11/2002 Suzuki et al. ..... 701/110
2007/0200347 A1 8/2007 Sulzer

FOREIGN PATENT DOCUMENTS

JP 01-117964 A 5/1989
JP 2010-167902 A 8/2010

* cited by examiner

*Primary Examiner* — Daniel V Venne

(74) *Attorney, Agent, or Firm* — Carrier Blackman & Associates, P.C.; Joseph P. Carrier; Jeffrey T. Gedeon

(57) ABSTRACT

In an apparatus for controlling operation of an outboard motor having an internal combustion engine and a generator driven by the engine, comprising: an actuator adapted to open and close a throttle valve of the engine; a neutral position detector adapted to detect whether a shift mechanism interposed between an output shaft of the engine and a propeller is in a neutral position; a power generation demand value detector adapted to detect a demand value for an amount of power generation of the generator; and an actuator controller adapted to determine a desired speed of the engine based on the detected demand value when the shift mechanism is detected to be in the neutral position, and control operation of the actuator such that a speed of the engine converges to the determined desired engine speed.

14 Claims, 9 Drawing Sheets

OUTBOARD MOTOR CONTROL APPARATUS

BACKGROUND

1. Technical Field

An embodiment of the invention relates to an outboard motor control apparatus, particularly to an apparatus for controlling an outboard motor equipped with a generator operated by an internal combustion engine.

2. Background Art

Conventionally, a variety of outboard motors having generators operated by internal combustion engines are proposed, as taught, for example, by Japanese Laid-Open Patent Application No. 2010-167902 (a paragraph 0041, FIGS. 1 and 8, etc.). In the reference, a solar panel is used as an additional power source in addition to a generator.

SUMMARY

Such a generator of an outboard motor is connectable with various electric loads such as lighting equipment and GPS (Global Positioning System), so that it is preferable that the generator of the outboard motor is capable of generating power corresponding to a connected electric load(s). To deal with it, the use of a larger generator or addition of another power source as taught in the reference is a possible approach for securing power generation sufficient for the electric load, but it causes the increase in size of the entire apparatus, disadvantageously.

An object of an embodiment of this invention is therefore to overcome the foregoing problem by providing an outboard motor control apparatus that has a generator and can secure power generation sufficient for the connected electric load(s) without increasing size of the entire apparatus.

In order to achieve the object, the embodiment of the invention provides in the first aspect an apparatus for controlling operation of an outboard motor having an internal combustion engine and a generator driven by the engine, comprising: an actuator that opens and closes a throttle valve of the engine; a neutral position detector that detects whether a shift mechanism interposed between an output shaft of the engine and a propeller is in a neutral position; and an electronic control unit (ECU) that detects a demand value for an amount of power generation of the generator, determines a desired speed of the engine based on the detected demand value when the shift mechanism is detected to be in the neutral position, and control operation of the actuator such that a speed of the engine converges to a desired engine speed determined based on the detected demand value.

In order to achieve the object, the embodiment of the invention provides in the second aspect a method for controlling operation of an outboard motor having an internal combustion engine, a generator driven by the engine, and an actuator adapted to open and close a throttle valve of the engine, comprising the steps of: detecting whether a shift mechanism interposed between an output shaft of the engine and a propeller is in a neutral position; detecting a demand value for an amount of power generation of the generator; and determining a desired speed of the engine based on the detected demand value when the shift mechanism is detected to be in the neutral position, and controlling operation of the actuator such that a speed of the engine converges to the determined desired engine speed.

BRIEF DESCRIPTION OF DRAWINGS

The above and other objects and advantages of an embodiment of the invention will be more apparent from the following description and drawings in which.

DESCRIPTION OF EMBODIMENT

An outboard motor control apparatus according to an embodiment of the present invention will now be explained with reference to the attached drawings.

Figure 1:
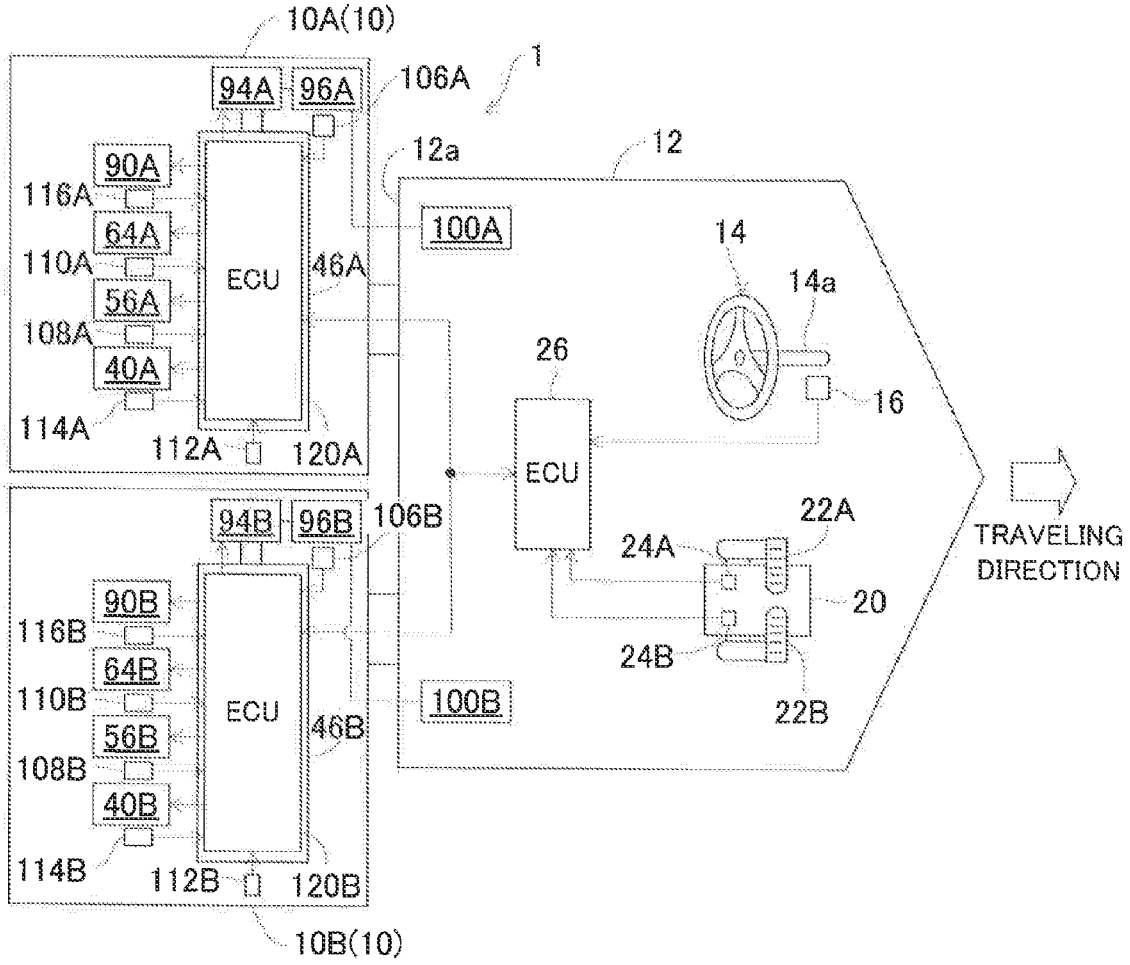
FIG. 1 is a block diagram showing an outboard motor control apparatus according to an embodiment of the invention.

FIG. 1 is a block diagram showing the outboard motor control apparatus according to the embodiment of the invention.

In FIG. 1, symbol 1 indicates a boat or vessel whose hull 12 is mounted with the outboard motor 10. The stern or transom 12*a* of the hull 12 of the boat 1 is mounted with a plurality of, i.e., two outboard motors 10. In other words, the boat 1 has what is known as a multiple or dual outboard motor installation. In the following, the port side outboard motor, i.e., outboard motor on the left side when looking in the direction of forward travel is called the "first outboard motor" and assigned by symbol 10A, while the starboard side outboard motor, i.e., outboard motor on the right side the "second outboard motor" and assigned by symbol 10B.

A steering wheel 14 is installed near a cockpit (the operator's seat) of the hull 12 to be manipulated by the operator (not shown). A steering angle sensor 16 is attached on a shaft 14*a* of the steering wheel 14 to produce an output or signal corresponding to steering angle of the steering wheel 14 applied or inputted by the operator.

A remote control box 20 provided near the cockpit includes a plurality of, i.e., two shift levers (shift/throttle levers) 22 installed to be manipulated by the operator. In the following, the shift lever for the first outboard motor 10A on the left side when looking in the direction of forward travel is called the "first shift lever 22A" and the shift lever for the second outboard motor 10B on the right side the "second shift lever 22B."

The first and second shift levers 22A, 22B can be moved or swung in the front-back direction from the initial position and are used by the operator to input shift change commands (forward, reverse and neutral switch commands) and engine speed regulation commands to the first and second outboard motors 10A, 10B. First and second lever position sensors 24A, 24B are respectively installed near the first and second shift levers 22A, 22B to produce outputs or signals corresponding to positions of the levers 22A, 22B.

The outputs of the steering angle sensor 16 and lever position sensors 24A, 24B are sent to an Electronic Control Unit (ECU) 26 disposed at a suitable position in the hull 12. The ECU 26 has a microcomputer including a CPU, ROM, RAM and other devices. Hereinafter the ECU 26 is called the "boat ECU."

Figure 2:
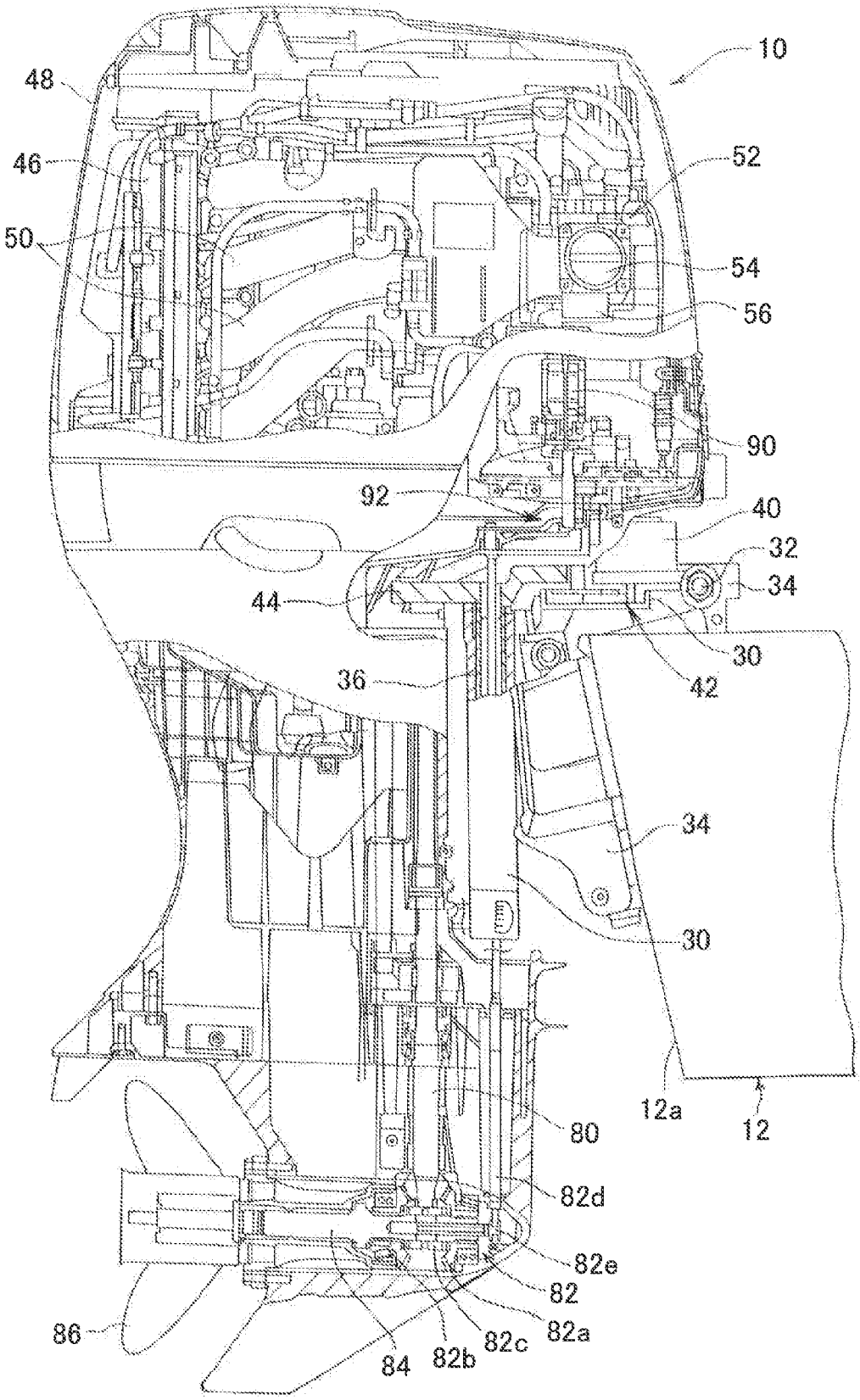
FIG. 2 is a sectional side view partially showing the outboard motor shown in FIG. 1.

FIG. 2 is a sectional side view partially showing the first outboard motor 10A shown in FIG. 1. Since the first and second outboard motors 10A, 10B have the substantially same configuration, the suffixes of A and B are omitted in the following explanation and figures unless necessary to distinguish the two outboard motors.

As shown in FIG. 2, the outboard motor 10 is fastened to the hull 12 through a swivel case 30, tilting shaft 32 and stern brackets 34.

An electric steering motor (actuator) 40 for driving a swivel shaft 36 which is housed in the swivel case 30 to be rotatable about the vertical axis, is installed at the upper portion in the swivel case 30. The rotational output of the steering motor 40 is transmitted to the swivel shaft 36 via a speed reduction gear mechanism 42 and mount frame 44, whereby the outboard motor 10 is rotated or steered about the swivel shaft 36 as a steering axis (about the vertical axis) to the right and left directions.

An internal combustion engine (prime mover; hereinafter referred to as the "engine") 46 is disposed at the upper portion of the outboard motor 10. The engine 46 comprises a spark-ignition, water-cooled, gasoline engine with a displacement of 2,200 cc. The engine 46 is located above the water surface and covered by an engine cover 48.

An air intake pipe 50 of the engine 46 is connected to a throttle body 52. The throttle body 52 has a throttle valve 54 installed therein and an electric throttle motor (actuator) 56 integrally attached thereto for opening and closing the throttle valve 54.

The output shaft of the throttle motor 56 is connected to the throttle valve 54 via a speed reduction gear mechanism (not shown). The throttle motor 56 is operated to open and close the throttle valve 54, thereby regulating a flow rate of air sucked in the engine 46.

Figure 3:
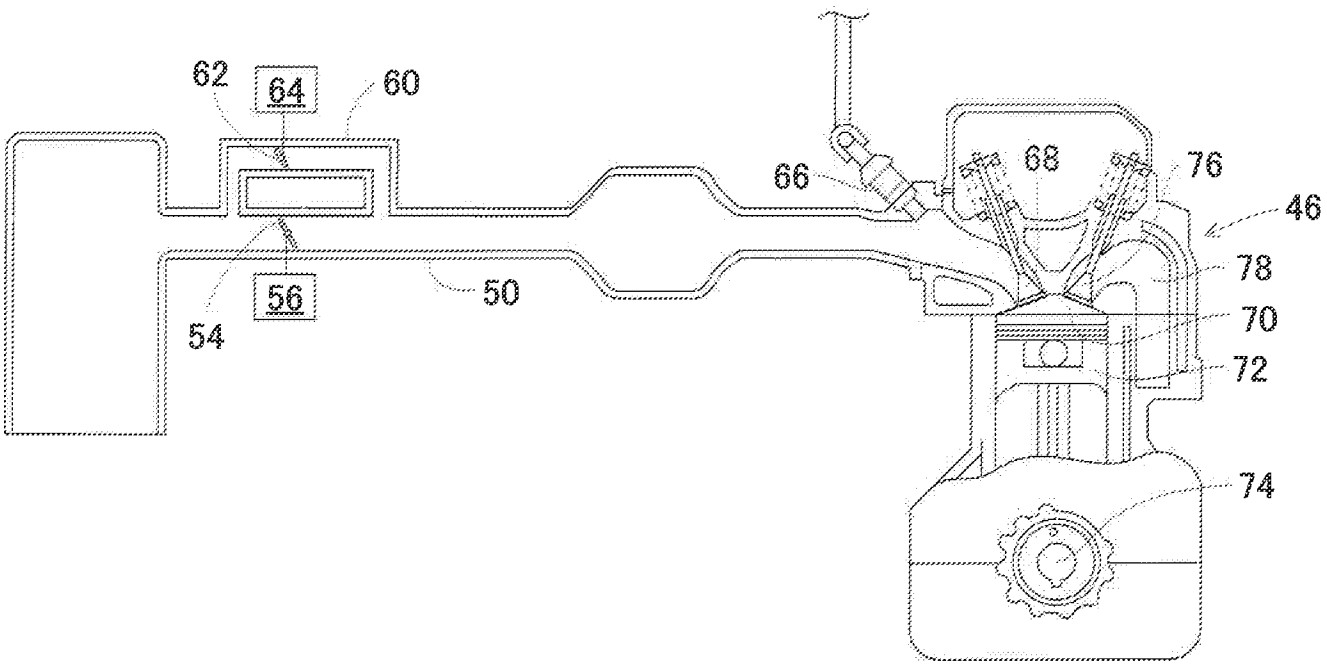
FIG. 3 is a schematic view of an internal combustion engine shown in FIG. 2, etc.

FIG. 3 is a schematic view of the engine 46 shown in FIG. 2, etc.

The explanation of the engine 46 is further made with reference to FIG. 3. The air intake pipe 50 is connected with a bypass (secondary air passage) 60 interconnecting the upstream side and downstream side of the throttle valve 54 to bypass the throttle valve 54. A secondary air flow rate regulating valve 62 for regulating a flow rate of intake air when the engine 46 is idling is installed in the bypass 60. The valve 62 is connected to a secondary air flow rate regulating electric motor (actuator) 64 through a speed reduction gear mechanism (not shown) and the motor 64 is operated to open and close the valve 62, thereby regulating the air flow rate in the bypass 60.

In the air intake pipe 50, an injector 66 is installed near an air intake port downstream of the throttle valve 54 for injecting gasoline fuel to intake air regulated by the throttle valve 54 and secondary air flow rate regulating valve 62. The injected fuel mixes with the intake air to form air-fuel mixture that flows into a combustion chamber 70 when an intake valve 68 is opened.

The air-fuel mixture flowing into the combustion chamber 70 is ignited by a spark plug (not shown) and burned, thereby driving a piston 72 downward in FIG. 3 to rotate a crankshaft 74. When an exhaust valve 76 is opened, the exhaust gas produced by the combustion passes through an exhaust pipe 78 to be discharged outside the engine 46.

Returning to the explanation on FIG. 2, the outboard motor 10 has a drive shaft (output shaft) 80 that is rotatably supported in parallel with the vertical axis. An upper end of the drive shaft 80 is connected to the crankshaft 74 (not shown in FIG. 2) of the engine 46 and a lower end thereof is connected through a shift mechanism 82 to a propeller shaft 84 that is rotatably supported in parallel with the horizontal axis. One end of the propeller shaft 84 is attached with a propeller 86. Thus, the shift mechanism 82 is interposed between the drive shaft 80, which is the output shaft of the engine 46, and the propeller 86.

The shift mechanism 82 includes a forward bevel gear 82*a* and reverse bevel gear 82*b* that are connected to the drive shaft 80 to be rotated thereby, a clutch 82*c* that serves to engage the propeller shaft 84 to either one of the forward and reverse bevel gears 82*a*, 82*b*, and other components.

An electric shift motor (actuator) 90 is installed in the engine cover 48 to operate the shift mechanism 82 to change a shift position. An output shaft of the shift motor 90 is connected to an upper end of a shift rod 82*d* of the shift mechanism 82 through a speed reduction gear mechanism 92. Consequently, when the shift motor 90 is operated, the shift rod 82*d* and a shift slider 82*e* are appropriately displaced to operate the clutch 82*c*, thereby changing or switching the shift position among the forward, reverse and neutral positions.

When the shift mechanism 82 is in the forward or reverse position, the rotation of the drive shaft 80 is transmitted to the propeller shaft 84 through the shift mechanism 82, so that the propeller 86 is rotated to generate thrust acting in the direction of making the hull 12 move forward or backward. On the other hand, when the shift mechanism 82 is in the neutral position, the propeller shaft 84 is not engaged with any of the forward and reverse bevel gears 82*a*, 82*b*, so that the transmission of the rotational output from the drive shaft 80 to the propeller shaft 84 is cut off.

Further, as shown in FIG. 1, the outboard motor 10 is connected to the engine 46 and equipped with a generator 94 that is operated by the engine 46 to generate power and with a battery 96 connected to the generator 94 to store the generated power.

Although not illustrated, the generator 94 comprises an Alternating Current Generator (ACG) having a rotor wound with a field coil and a stator wound with a stator coil. In the generator 94, when electric current flows through the field coil, the rotor is magnetized so that the north pole and south pole are formed, and when the magnetized rotor is rotated by the engine 46 output, current (power) is generated at the stator coil.

It is possible to regulate an amount of power generation of the generator 94 by controlling current flowing through the field coil (hereinafter called the "field coil current"). Specifically, when the field coil current is increased, since it intensifies magnetic field of the rotor, current generated at the stator coil is increased so that the amount of power generation can be increased accordingly.

Further, the amount of power generation of the generator 94 is proportional to rotating speed of the engine 46, i.e., it is increased with increasing engine speed. Alternating current thus-generated by the generator 94 is rectified and supplied to the battery 96 to charge it.

The battery 96 is connectable through connectors (not shown) with a variety of electric loads (e.g., lighting equipment, a GPS, a fishfinder, etc.) 100 installed at the hull 12 and is also connected with the foregoing motors 40, 56, 64, 90 to supply operating power thereto.

An electric load 100A connected to the battery 96A of the first outboard motor 10A can be either the same as or different from an electric load 100B connected to the battery 96B of the second outboard motor 10B.

Figure 4:
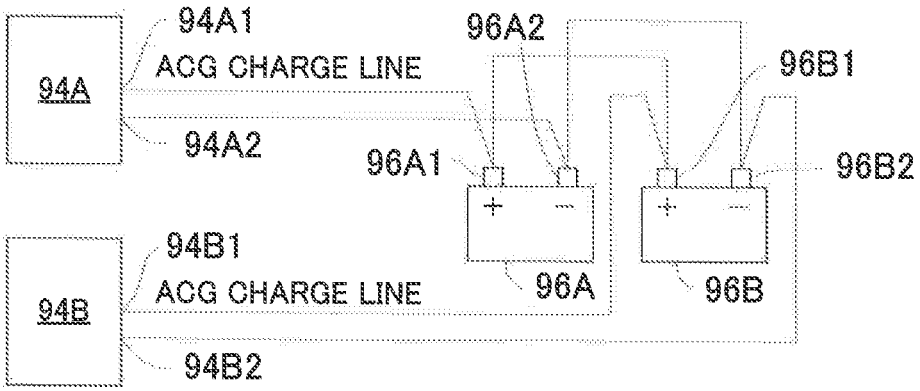
FIG. 4 is an explanatory view showing details of connection of generators and batteries of first and second outboard motors shown in FIG. 1.

FIG. 4 is an explanatory view showing details of connection of the generators 94A, 94B and batteries 96A, 96B of the first and second outboard motors 10A, 10B.

As shown in FIG. 4, a positive output terminal 94A1 of the generator 94A is connected to a positive terminal 96A1 of the battery 96A through an electric wire, while a positive output terminal 94B1 of the generator 94B is connected to a positive terminal 96B1 of the battery 96B through an electric wire, and the positive terminals 96A1, 96B1 are connected to each other. Similarly, a negative output terminal 94A2 of the generator 94A is connected to a negative terminal 96A2 of the battery 96A through an electric wire, while a negative output terminal 94B2 of the generator 94B is connected to a negative terminal 96B2 of the battery 96B through an electric wire, and the negative terminals 96A2, 96B2 are connected to each other.

Thus the batteries 96A, 96B are connected in parallel between the generators 94A, 94B, so that each of the generators 94A, 94B can charge either one of the batteries 96A, 96B.

The explanation on FIG. 1 will be resumed. A voltage sensor 106 is connected to the battery 96 to produce an output or signal indicative of battery voltage. A throttle opening sensor 108 is installed near the throttle valve 54 to produce an output or signal indicative of a throttle opening and an opening sensor 110 is installed near a secondary air flow rate regulating valve 62 to produce an output or signal indicative of an opening of the valve 62.

A crank angle sensor 112 is disposed near the crankshaft 74 of the engine 46 and produces a pulse signal at every predetermined crank angle. Further, a rudder angle sensor 114 is installed near the swivel shaft 36 to produce an output or signal indicative of a rotational angle of the swivel shaft 36, i.e., a rudder angle of the outboard motor 10.

Furthermore, a neutral switch (neutral position detector or neutral position detecting means) 116 is provided near the shift motor 90 and detects whether the shift mechanism 82 is in the neutral position. When the shift mechanism 82 is in the neutral position, the switch 116 outputs an ON signal and when it is in the forward or reverse position (in-gear), the switch 116 outputs an OFF signal.

The outputs of the foregoing sensors and switch are sent to an outboard motor ECU 120 mounted on the same outboard motor. In the following, the ECU on the first outboard motor 10A is called the "first outboard motor ECU 120A" and that on the second outboard motor 10B the "second outboard motor ECU 120B." Each of the first and second outboard motor ECUs 120A, 120B has a microcomputer including a CPU, ROM, RAM and other devices, similarly to the boat ECU 26.

The first and second outboard motor ECUs 120A, 120B and the boat ECU 26 are interconnected to be able to communicate with each other through, for example, a communication method standardized by the National Marine Electronics Association (NMEA), i.e., through a Controller Area Network (CAN). The first and second outboard motor ECUs 120A, 120B acquire information including the steering angle of the steering wheel 14, a power generation increasing coordination control permission flag (described later), a desired engine speed for a coordinated operation (hereinafter called the "coordination desired speed"), etc., from the boat ECU 26, while the boat ECU 26 acquires information including operating conditions of the engines 46, power generating conditions of the generators 94, etc., from the outboard motor ECUs 120A, 120B.

Based on the received (or acquired) output of the steering angle sensor 16, the first outboard motor ECU 120A controls the operation of the steering motor 40A to steer the first outboard motor 10A. Further, based on the output of the first lever position sensor 24A, etc., the first outboard motor ECU 120A controls the operations of the throttle motor 56A and secondary air flow rate regulating electric motor 64A to open and close the throttle valve 54 and secondary air flow rate regulating valve 62, thereby regulating the flow rate of intake air, while controlling the operation of the shift motor 90A to operate the shift mechanism 82 to change the shift position.

Also, based on the output indicative of voltage of the battery 96A sent from the voltage sensor 106A, the first outboard motor ECU 120A controls (i.e., PWM-controls) the field coil current of the generator 94A using a duty ratio to regulate the amount of power generation.

To be more specific, in the case where, for instance, one electric load 100A is additionally connected and the battery voltage is decreased accordingly, the duty ratio is increased (i.e., the field coil current is increased) to increase the amount of power generation (specifically, when the duty ratio is 100%, it means that current always flows through the field coil). In contrast, in the case where the battery voltage is increased, the duty ratio is decreased (i.e., the field coil current is decreased) to decrease the amount of power generation. Thus, since the duty ratio is changed in accordance with the number or volume of the electric load(s) 100A connected to the battery 96A, it can be said that the duty ratio is equivalent to a demand value required for power generation of the generator 94A.

Since the operation of the second outboard motor ECU 120B is the same as that of the first outboard motor ECU 120A, the explanation thereof is omitted. Thus the operations of the first and second outboard motors 10A, 10B are respectively controlled by the first and second outboard motor ECUs 120A, 120B, separately.

As mentioned above, the apparatus according to this embodiment is a DBW (Drive-By-Wire) control apparatus whose operation system (steering wheel 14 and shift lever 22) has no mechanical connection with the outboard motor 10.

Figure 5:
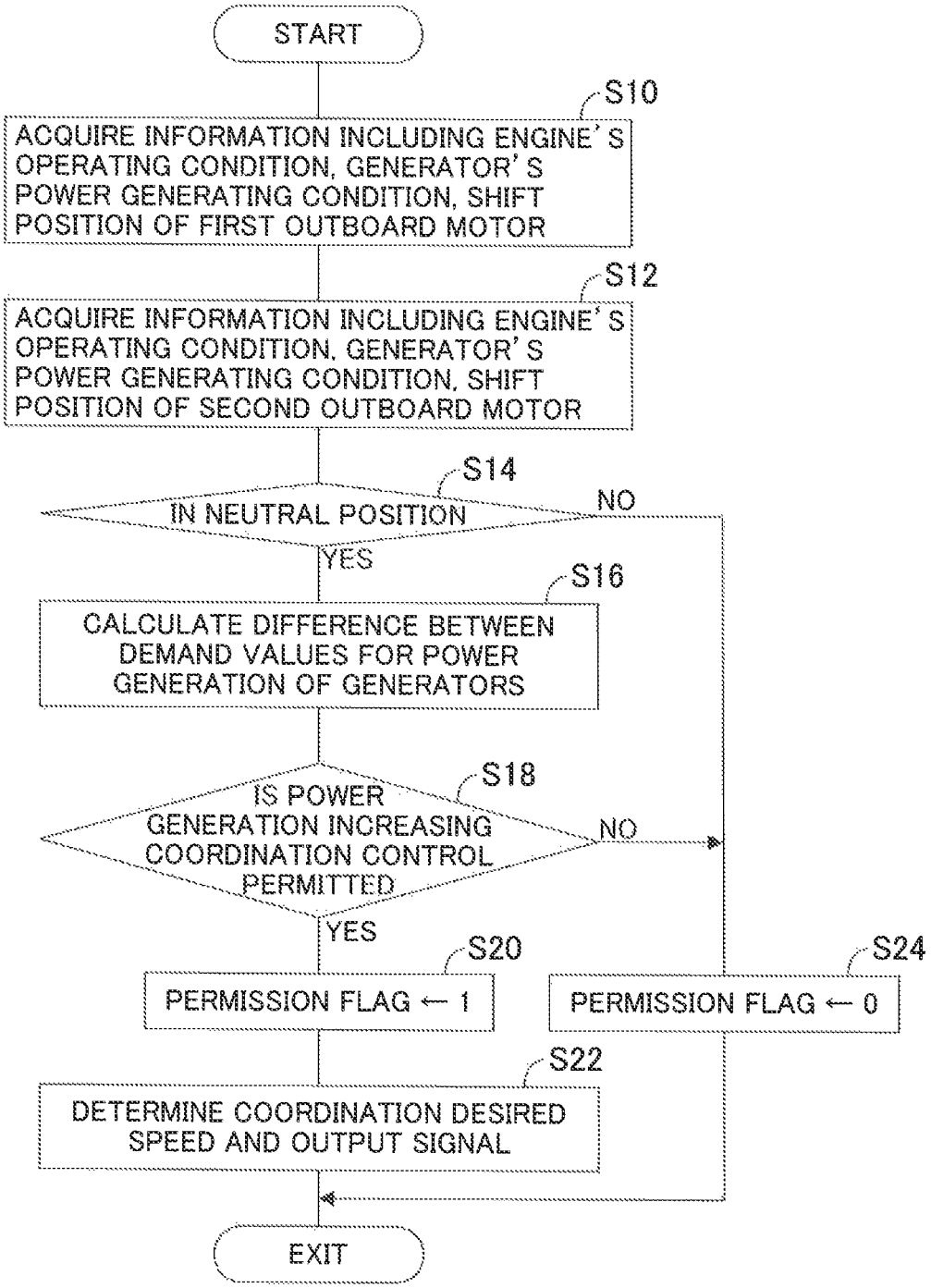
FIG. 5 is a flowchart showing a coordination control permission determining operation of the outboard motors to be executed by a boat ECU shown in FIG. 1.
Figure 6:
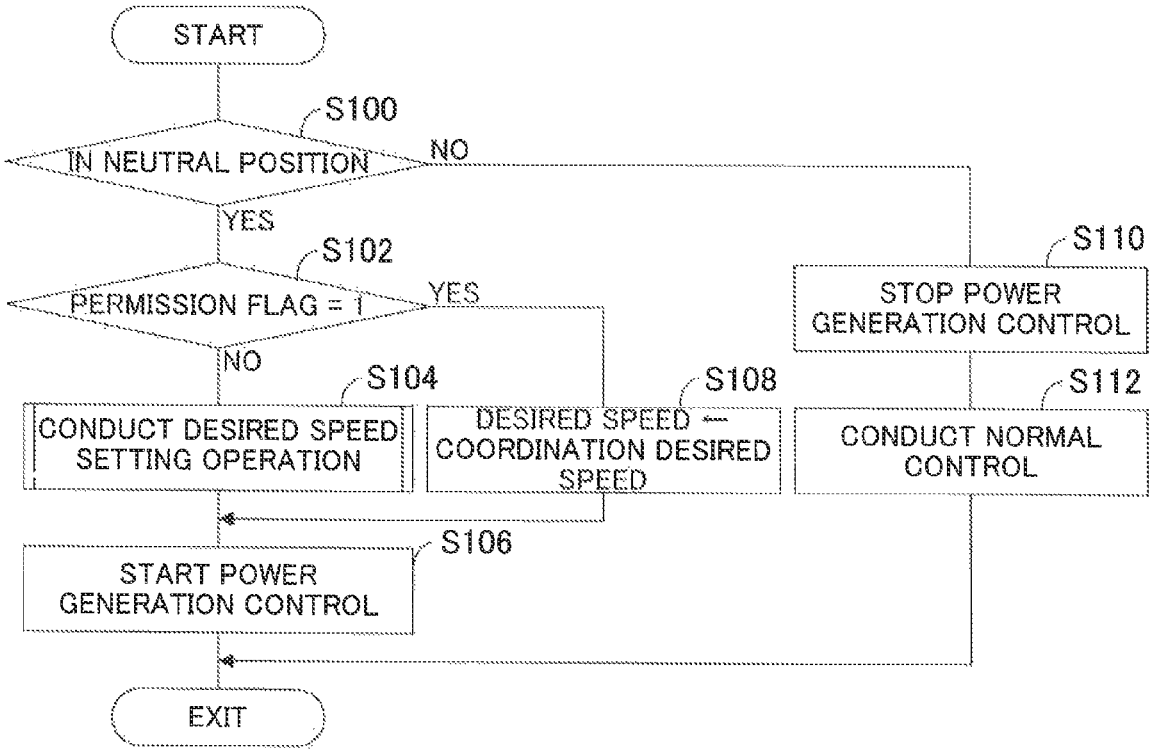
FIG. 6 is a flowchart showing an engine control operation executed by a first outboard motor ECU shown in FIG. 1.

FIG. 5 is a flowchart showing a coordination control permission determining operation of the outboard motors 10A, 10B to be executed by the boat ECU 26 and FIG. 6 is a flowchart showing an engine control operation executed by the first outboard motor ECU 120A. The illustrated programs are concurrently executed at predetermined intervals (e.g., 100 milliseconds) by the boat ECU 26 and first outboard motor ECU 120A. Note that the operation of the first outboard motor ECU 120A shown in FIG. 6 is also performed by the second outboard motor ECU 120B, so that the explanation on FIG. 6 can be applied to the second outboard motor ECU 120B.

In FIG. 5, the program begins at S (Step; Processing step) 10 in which information on the first outboard motor 10A including the operating condition of the engine 46A, the power generating condition of the generator 94A and the shift position is acquired. Specifically, a desired engine speed to be set through a process explained later, the duty ratio used to control the field coil current of the generator 94A to be detected through the same process, and a signal indicating the output of the neutral switch 116A are acquired (read out) from the first outboard motor ECU 120A.

The program proceeds to S12 in which, similarly, information on the second outboard motor 10B including the operating condition of the engine 46B, the power generating condition of the generator 94B and the shift position is acquired from the second outboard motor ECU 120B.

Next the program proceeds to S14 in which, based on the information of the shift positions acquired in S10 and S12, it is determined whether the shift mechanisms 82 of the outboard motors 10A, 10B are both in the neutral position, i.e., whether the both outputs of the neutral switches 116A, 116B are the ON signals.

When the result in S14 is affirmative, the program proceeds to S16 in which, based on the information of the power generating conditions of the generators 94A, 94B, a difference between the demand values for power generation of the generators 94A, 94B is calculated. As mentioned above, the demand value is expressed with the duty ratio used for controlling the field coil current and accordingly, the difference here is obtained by subtracting the duty ratio of the generator 94B of the second outboard motor 10B from the duty ratio of the generator 94A of the first outboard motor 10A.

Next the program proceeds to S18 in which it is determined whether to permit the execution of power generation increasing coordination control in which the engines 46A, 46B of the outboard motors 10A, 10B are operated in the coordinated manner to increase the amount of power generation of the generators 94.

Specifically, an absolute value of the calculated difference between the demand values (duty ratios) is compared to a predetermined value and when the absolute value is equal to or greater than the predetermined value, the execution of the power generation increasing coordination control is permitted. The predetermined value is set as a criterion for determining whether the amounts of power generation of the generators 94A, 94B relatively greatly differ from each other, e.g., set to 20%.

When the result in S18 is affirmative, the program proceeds to S20 in which the bit of the power generation increasing coordination control permission flag (hereinafter called the "permission flag") is set to 1. The bit of the permission flag is set to 1 when the shift mechanisms 82 of the first and second outboard motors 10A, 10B are both in the neutral position and the difference between the demand values of the generators 94A, 94B are relatively large, and otherwise, reset to 0.

Next the program proceeds to S22 in which the desired speeds of the engines 46A, 46B of the outboard motors 10A, 10B acquired in S10 and S12 are compared to each other, the higher (highest) value thereof is determined or set as the "coordination desired speed," and a signal indicative of the determined coordination desired speed is sent to the first and second outboard motor ECUs 120A, 120B.

On the other hand, when the result in S14 or S18 is negative, the program proceeds to S24 in which the bit of the permission flag is reset to 0 and the program is terminated.

Next, the explanation on FIG. 6 will be made. First, in S100, based on the output of the neutral switch 116, it is determined whether the shift mechanism 82 is in the neutral position. When the result in S100 is affirmative, the program proceeds to S102 in which it is determined whether the bit of the permission flag is 1.

When the result in S102 is negative, i.e., when the control for operating the engines 46A, 46B of the outboard motors 10A, 10B in the coordinated manner is not permitted, the program proceeds to S104 in which the operation to determine or set the desired speed of the engine 46 is conducted.

Figure 7:
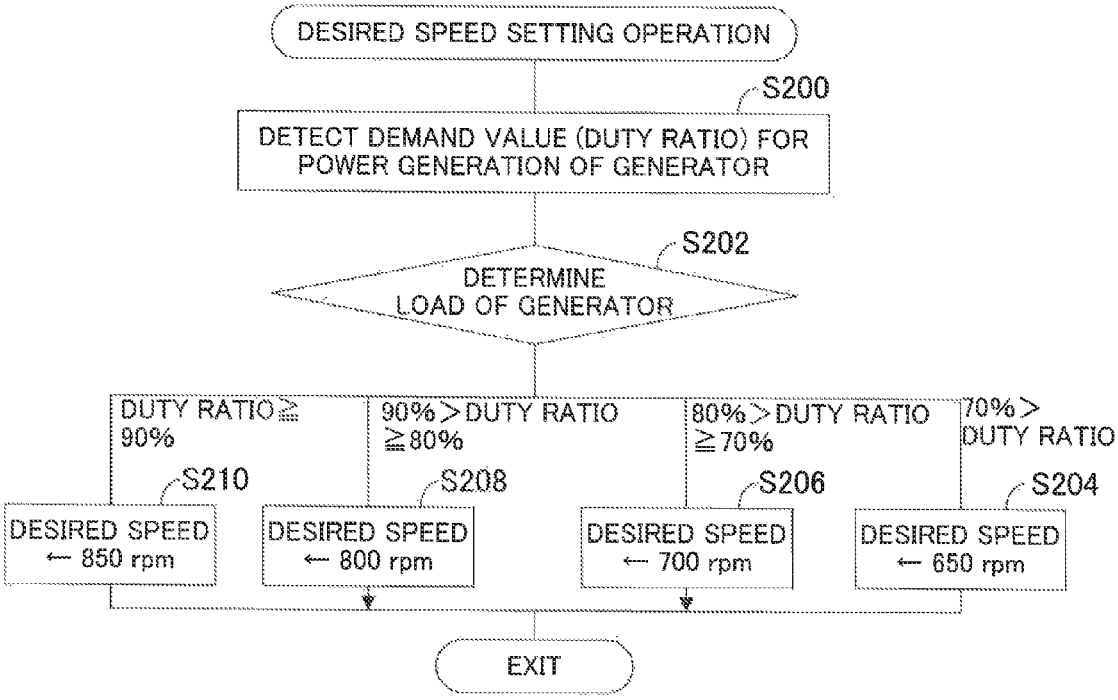
FIG. 7 is a subroutine flowchart showing a desired speed setting operation shown in FIG. 6.

FIG. 7 is a subroutine flowchart showing the desired speed setting operation.

As shown in FIG. 7, in S200, the demand value for power generation of the generator 94 is detected, i.e., the duty ratio corresponding to the demand value is detected. As understood from the foregoing discussion, the outboard motor ECUs 120A, 120B function as a detector which detects, or as a power generation demand value detecting means for detecting, such demand value at S200. Next the program proceeds to S202 in which the load of the generator 94 is determined based on the detected duty ratio.

Specifically, in S202, when the duty ratio used to control the field coil current is less than 70% so that the load is determined (or estimated) to be low, the program proceeds to S204 in which the desired speed is set to a relatively low value (e.g., 650 rpm). When the duty ratio is equal to or greater than 70% and less than 80% so that the load is determined to be somewhat low, the program proceeds to S206 in which the desired speed is set to a slightly low value (e.g., 700 rpm).

When the duty ratio is equal to or greater than 80% and less than 90% so that the load is determined to be somewhat high, the program proceeds to S208 in which the desired speed is set to a slightly high value (e.g., 800 rpm). When the duty ratio is equal to or greater than 90% so that the load is determined to be high, the program proceeds to S210 in which the desired speed is set to a relatively high value (e.g., 850 rpm).

Figure 8:
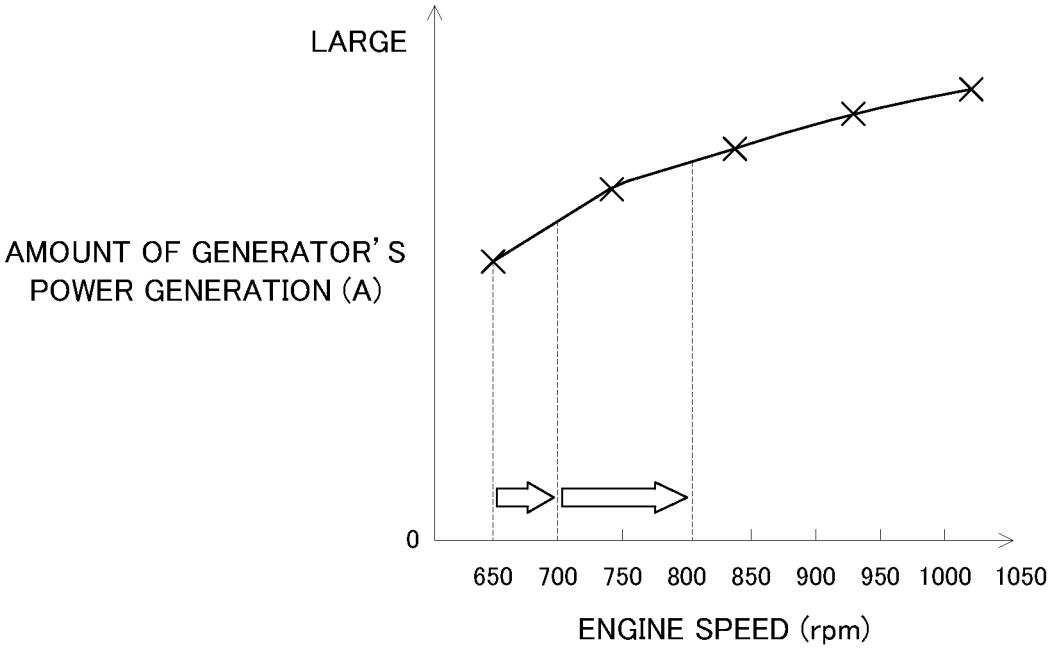
FIG. 8 is a graph showing the characteristics of a generator output with respect to an engine speed, which is used in the FIG. 7 flowchart.

The foregoing example values of the desired speeds are appropriately set based on the output characteristics of the generator 94 as shown in FIG. 8. Specifically, when the load of the generator 94 is determined to be low, since a small amount of power generation suffices, the desired speed is set to be low, while when the load is determined to be high, the desired speed is set to be high so as to increase the amount of power generation. Note that the upper limit value of the desired speed is set by taking into account the impact which arises when the shift position is changed from the neutral position to the forward (or reverse) position, e.g., set to 850 rpm.

The explanation on FIG. 6 will be resumed. The program proceeds to S106 in which power generation control is started. Specifically, the operation of the throttle motor 56 or secondary air flow rate regulating electric motor 64 is controlled so that the engine speed detected by counting the output pulses of the crank angle sensor 112A converges to the desired speed (i.e., so that the engine speed becomes the same as the desired speed).

When the result in S102 is affirmative, the program proceeds to S108 in which the coordination desired speed is determined as the desired speed, and to S106 in which the power generation control is started, i.e., the operation of the throttle motor 56, etc., is controlled so that the engine speed converges to the desired speed (coordination desired speed).

To be more specific, when the result in S102 is affirmative, i.e., when the absolute value of the difference between the demand values for power generation of the generators 94A, 94B is equal to or greater than the predetermined value (for example, when the demand value of the first outboard motor 10A is solely relatively large), if the desired speed of only the first outboard motor 10 is increased, it leads to the increase in the engine speed of only one outboard motor, so that the engine sound becomes louder and it causes a disadvantage for the operator to have an uncomfortable feel.

To deal with it, the outboard motor control apparatus according to this embodiment is configured such that, as mentioned above, the "coordination desired speed" that is the higher (highest) value of the engine speeds set for the first and second outboard motors 10A, 10B is determined as the desired speed, i.e., such that the first and second outboard motors 10A, 10B have the unitary desired speed. As a result, all the outboard motors 10A, 10B can be operated at the same engine speed and it becomes possible to avoid the aforesaid disadvantage. As understood from the foregoing discussion, the boat ECU 26 functions as a demand value difference calculator which calculates, or as a demand value difference calculating means for calculating, a difference between demand values detected at the plurality of outboard motors, at S16.

When the result in S100 is negative, the program proceeds to S110 in which the power generation control is not conducted or, in the case where the power generation control is in execution, it is stopped. Next the program proceeds to S112 in which the normal control of the engine 46 is conducted. Specifically, the desired speed is determined based on the output of the first lever position sensor 24A and the operation of the throttle motor 56, etc., is controlled so that the engine speed converges to the desired speed. As understood from the foregoing discussion, at steps S100, S104, S106, and S202-S210 the outboard motor ECUs 120A, 120B function as an actuator controller which determines a desired speed of the engine based on the detected demand value when the shift mechanism is detected to be in the neutral position, and which controls operation of the actuator such that a speed of the engine converges to the determined desired engine speed, or as an actuator controlling means for determining a desired speed of the engine based on the detected demand value when the shift mechanism is detected to be in the position, and controlling operation of the actuator such that a speed of the engine converges to the determined desired engine speed.

Figure 9:
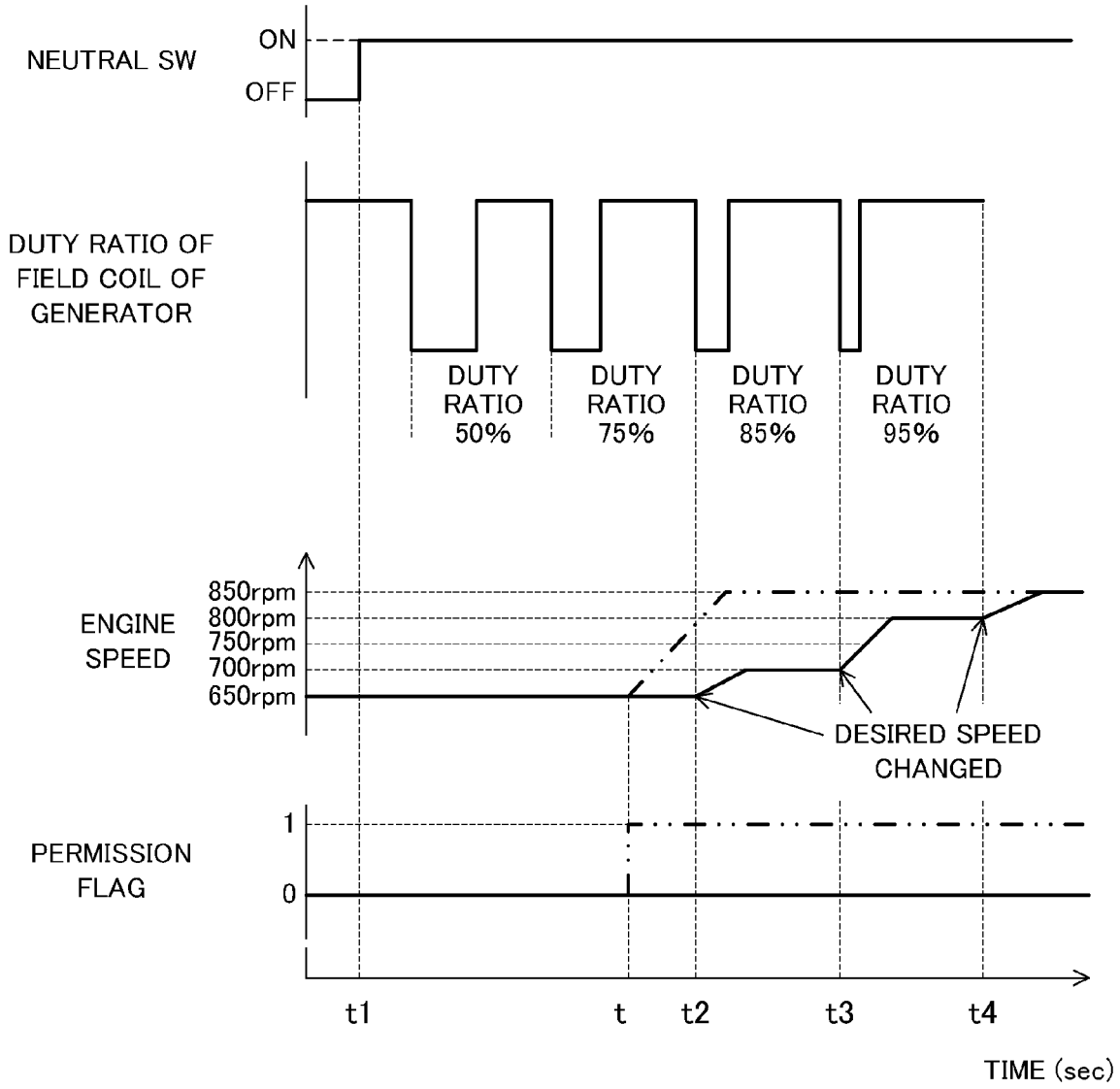
FIG. 9 is a time chart for explaining a part of the processes of flowcharts in FIGS. 5 to 7.

FIG. 9 is a time chart for explaining a part of the processes of flowcharts in FIGS. 5 to 7. FIG. 9 shows, in order from the top, the output status of the neutral switch 116A of the first outboard motor 10A, the duty ratio of the field coil of the generator 94A, the rotating speed of the engine 46A, and the bit of the permission flag.

As shown in FIG. 9, at the time t1, the neutral switch 116A is made ON, i.e., the shift position is changed to the neutral position in the shift mechanism 82. From the time t1 to t2, the duty ratio is determined to be less than 70%, so that the desired speed, i.e., the engine speed is set to 650 rpm (S204). When, at the time t2, the duty ratio is determined to be 75%, the desired speed is set to 700 rpm and accordingly, the engine speed is increased to 700 rpm (S206).

Similarly, when, at the time t3, the duty ratio is determined to be 85%, the desired speed is set to 800 rpm and accordingly, the engine speed is gradually increased (S208). When, at the time t4, the duty ratio is determined to be 95%, the desired speed is set to 850 rpm and accordingly, the engine speed is increased to 850 rpm (S210).

As indicated by imaginary lines in FIG. 9, when the bit of the permission flag is set to 1 at the time ta, i.e., when another electric load 100B is additionally connected to the battery 96B of the second outboard motor 10B at the time ta and the demand value (duty ratio) for power generation of the generator 94B is increased to 95% so that the difference between the demand values becomes the predetermined value (20%) or more, the desired speed of the second outboard motor 10B is set to 850 rpm and the coordination desired speed is also set to 850 rpm. Consequently, the coordination desired speed is set as the desired speed of the first outboard motor 10A regardless of the demand value (duty ratio) of the generator 94A thereof, so that the engine speed of the outboard motor 10A is controlled to be 850 rpm (S102, S108).

As stated above, this embodiment is configured to have an apparatus or a method for controlling operation of an outboard motor (first and second outboard motors 10A, 10B) having an internal combustion engine (46) and a generator (94) driven by the engine, comprising: an actuator (throttle motor 56) adapted to open and close a throttle valve (54) of the engine; a neutral position detector (neutral switch or neutral position detecting means 116) adapted to detect whether a shift mechanism (82) interposed between an output shaft (drive shaft; 80) of the engine and a propeller (86) is in a neutral position; a power generation demand value detector or power generation demand value detecting means (first and second outboard motor ECUs 120A, 120B, S200) adapted to detect a demand value (duty ratio) for an amount of power generation of the generator; and an actuator controller or actuator controlling means (first and second outboard motor ECUs 120A, 120B, S100, S104, S106, S202 to S210) adapted to determine a desired speed of the engine (i.e., desired engine speed) based on the detected demand value when the shift mechanism is detected to be in the neutral position, and control operation of the actuator such that a speed of the engine converges to the determined desired engine speed.

With this, it becomes possible to secure power generation sufficient for the connected electric load(s) 100 without increasing size of the entire apparatus. For instance, when the demand value for power generation of the generator 94 is increased, it is possible to increase the desired speed of the engine 46 accordingly, so that the engine speed is increased and it increases the amount of power generation of the generator 94, thereby securing power generation sufficient for the electric load(s). Further, since the installment of another power source or the like is unnecessary, the increase in the size of the apparatus can be avoided.

Further, since the desired speed is controlled (i.e., the engine speed is controlled) with the shift mechanism 82 positioned in the neutral position, even when the engine speed is increased in accordance with the demand value, the output of the engine 46 is not transmitted to the propeller 86 and hence, it becomes possible to avoid a trouble, such as the increase in the boat speed contrary to the operator's expectation.

In the apparatus or method, a plurality (two) of the outboard motors (10A, 10B) are mounted on a boat (1), and the apparatus or method further includes: a demand value difference calculator or demand value difference calculating means (boat ECU 26, S16) adapted to calculate a difference between the demand values detected at the plurality of the outboard motors, and the actuator controller determines a highest value (coordination desired speed) of speeds set based on the demand values as the desired speed for all the plurality of the outboard motors when the calculated difference is equal to or greater than a predetermined value (20%) (S102, S108). With this, it becomes possible to prevent the increase in the engine speed(s) of only one (a part) of the outboard motors, which may cause louder engine sound.

To be more specific, when the difference between the demand values for power generation of the generators 94A, 94B of the outboard motors 10A, 10B is equal to or greater than the predetermined value, i.e., when, for example, the demand value of one of the outboard motors 10A, 10B is solely relatively large, if the desired speed of the one is solely increased, it leads to the increase in the engine speed of only one outboard motor, so that the engine sound becomes louder and it causes a disadvantage for the operator to have an uncomfortable feel. However, since the embodiment is configured such that, as mentioned above, the highest value of the engine speeds set for a plurality of the outboard motors 10A, 10B is determined as the desired speed, i.e., such that the outboard motors 10A, 10B have the unitary desired speed, all the outboard motors 10A, 10B can be operated at the same engine speed and it becomes possible to avoid the aforesaid disadvantage.

Further, when the difference between the demand values for power generation of the generators 94A, 94B is equal to or greater than the predetermined value (i.e., when, for example, the demand value of one of the outboard motors 10A, 10B is solely relatively large), the desired speeds of all the outboard motors 10A, 10B can be increased to increase the total amount of power generation of all the generators 94A, 94B. Consequently, the burden on one generator with the relatively large demand value can be mitigated, thereby improving the durability of the generators 94A, 94B.

In the apparatus or method, the desired speed determined based on the detected demand value is set with an upper limit value. Since the upper limit value can be set by taking into account the impact which arises when the shift position is changed from the neutral position to the forward (or reverse) position for example, it becomes possible to prevent the impact from arising with the change of the shift position.

In the apparatus or method, the power generation demand value detector detects the demand value based on a duty ratio of the generator. With this, it becomes possible to accurately and easily detect the demand value for power generation of the generator.

It should be noted that, although the outboard motor is exemplified above, this invention can be applied to an inboard/outboard motor equipped with an internal combustion engine and generator.

It should also be noted that, although two outboard motors are mounted on the boat 1, the invention also applies to multiple outboard motor installations comprising three or more outboard motors. Further, although the predetermined value, the desired speeds corresponding to the duty ratios, the displacement of the engine 46 and other values are indicated with specific values in the foregoing, they are only examples and not limited thereto.

Japanese Patent Application No. 2011-128264, filed on Jun. 8, 2011, is incorporated by reference herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. An apparatus for controlling operation of an outboard motor having an internal combustion engine and a generator driven by the engine, comprising:

an actuator that opens and closes a throttle valve of the engine;

a neutral position detector that detects whether a shift mechanism interposed between an output shaft of the engine and a propeller is in a neutral position; and an electronic control unit (ECU) that detects a demand value for an amount of power generation of the generator, determines a desired speed of the engine based on the detected demand value when the shift mechanism is detected to be in the neutral position, and controls operation of the actuator such that a speed of the engine converges to a desired engine speed determined based on the detected demand value.

2. The apparatus according to claim 1, wherein a plurality of outboard motors are mounted on a boat each of which has an internal combustion engine and a generator driven by the engine, and the apparatus further including:

another electronic control unit (ECU) which calculates a difference between the demand values detected at the plurality of the outboard motors, and determines a highest value of engine speeds set based on the demand values as the desired engine speed for all the plurality of the outboard motors when the calculated difference is equal to or greater than a predetermined value.

3. The apparatus according to claim 1, wherein the desired engine speed determined based on the detected demand value is set with an upper limit value.

4. The apparatus according to claim 1, wherein the ECU detects the demand value based on a duty ratio of the generator.

5. An apparatus for controlling operation of an outboard motor having an internal combustion engine and a generator driven by the engine, comprising:

an actuator that opens and closes a throttle valve of the engine;

a neutral position detector that detects whether a shift mechanism interposed between an output shaft of the engine and a propeller is in a neutral position;

actuator controlling means for detecting a demand value for an amount of power generation of the generator, and for determining a desired speed of the engine based on the detected demand value when the shift mechanism is detected to be in the neutral position, and controlling operation of the actuator such that a speed of the engine converges to a desired engine speed determined based on the detected demand value.

6. The apparatus according to claim 5, wherein a plurality of outboard motors are mounted on a boat each of which has an internal combustion engine, a generator driven by the engine, and actuator controlling means, and the apparatus further includes:

demand value difference calculating means for calculating a difference between demand values detected at the plurality of the outboard motors, and the actuator controlling means determines a highest value of speeds set based on the demand values as the desired engine speed for all the plurality of the outboard motors when the calculated difference is equal to or greater than a predetermined value.

7. The apparatus according to claim 5, wherein the desired engine speed determined based on the detected demand value is set with an upper limit value.

8. The apparatus according to claim 5, wherein the actuator controlling means detects the demand value based on a duty ratio of the generator.

9. A method for controlling operation of an outboard motor having an internal combustion engine, a generator driven by the engine, an actuator that opens and closes a throttle valve of the engine, and a neutral position detector that detects whether a shift mechanism interposed between an output shaft of the engine and a propeller is in a neutral position, the method comprising the steps of:

detecting a demand value for an amount of power generation of the generator; and determining a desired speed of the engine based on the detected demand value when the shift mechanism is detected to be in the neutral position, and controlling operation of the actuator such that a speed of the engine converges to a desired engine speed determined based on the detected demand value.

10. The method according to claim 9, further comprising the steps of:

calculating a difference between demand values detected at a plurality of outboard motors mounted on a boat each of which has an internal combustion engine and a generator driven by the engine, and determining a highest value of speeds set based on the demand values as the desired engine speed for all the plurality of the outboard motors when the calculated difference is equal to or greater than a predetermined value.

11. The method according to claim 9, wherein the desired engine speed determined based on the detected demand value is set with an upper limit value.

12. The method according to claim 9, wherein the step of detecting the demand value involves detecting the demand value based on a duty ratio of the generator.

13. The apparatus according to claim 5, wherein the actuator controlling means includes an electronic control unit (ECU) that is programmed to detect a demand value for an amount of power generation of the generator, to determine a desired speed of the engine based on the detected demand value when the shift mechanism is detected to be in the neutral position, and to control operation of the actuator such that a speed of the engine converges to a desired engine speed determined based on the detected demand value.

14. The apparatus according to claim 5, wherein the actuator controlling means includes an electronic control unit (ECU) that is programmed to detect a demand value for an amount of power generation of the generator, to determine a desired speed of the engine based on the detected demand value when the shift mechanism is detected to be in the neutral position, and to control operation of the actuator such that a speed of the engine converges to a desired engine speed determined based on the detected demand value, and the demand value difference calculating means includes another electronic control unit (ECU) that is programmed to calculating a difference between demand values detected at the plurality of the outboard motors.

* * * * *